US007212752B2

(12) United States Patent
Hirota et al.

(10) Patent No.: US 7,212,752 B2
(45) Date of Patent: May 1, 2007

(54) IMAGE FORMING APPARATUS AND A DEVELOPING APPARATUS HAVING A UNIT FOR DETERMINING A MIXTURE RATIO OF TWO TYPES OF MAGNETIC TONER BASED ON MAGNETIC PERMEABILITY AND AMOUNT

(75) Inventors: Soh Hirota, Aichi-ken (JP); Masaki Tanaka, Toyohashi (JP); Masahiro Kouzaki, Toyohashi (JP); Kazuomi Sakatani, Toyokawa (JP); Mitsuru Obara, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 262 days.

(21) Appl. No.: 10/976,773

(22) Filed: Nov. 1, 2004

(65) Prior Publication Data

US 2006/0029403 A1 Feb. 9, 2006

(30) Foreign Application Priority Data

Aug. 5, 2004 (JP) ..... 2004-229099

(51) Int. Cl.
*G03G 15/08* (2006.01)

(52) U.S. Cl. ..... 399/27; 399/30

(58) Field of Classification Search ..... 399/27, 399/28, 30, 61, 63, 258, 259
See application file for complete search history.

(56) References Cited

U.S. PATENT DOCUMENTS 3,650,797 A * 3/1972 Tomanek ..... 430/49
4,113,371 A * 9/1978 Fraser et al. ..... 399/226
4,142,981 A * 3/1979 Bean et al. ..... 430/106.2
4,165,393 A * 8/1979 Suzuki et al. ..... 430/122
4,235,194 A * 11/1980 Wada et al. ..... 399/138
4,331,757 A * 5/1982 Tanaka et al. ..... 430/122
4,404,269 A * 9/1983 Miyakawa et al. ..... 430/106.2
4,862,213 A * 8/1989 Ichihara et al. ..... 399/58
4,990,960 A * 2/1991 Umetani ..... 399/39
5,717,973 A 2/1998 Endoh et al.

FOREIGN PATENT DOCUMENTS

JP 58-168058 A 10/1983
JP 589035566 A * 2/1984

(Continued)

OTHER PUBLICATIONS

Japanese Notification of Reasons for Refusal mailed on Sep. 19, 2006.

(Continued)

*Primary Examiner*—Robert Beatty
(74) *Attorney, Agent, or Firm*—Morrison & Foerster LLP

(57) ABSTRACT

An electrophotographic image forming apparatus includes a developer reservoir for accommodating a single-component mixed developer including two types of toner having a generally identical hue and different reflection densities. A magnetic substance is added to one of the two types of toner. The apparatus also includes a detector for detecting a magnetic permeability of the developer in the developer reservoir and a unit for determining a mixture ratio of the two types of toner based on the magnetic permeability of the developer detected by the detector.

2 Claims, 7 Drawing Sheets

FOREIGN PATENT DOCUMENTS

| | | | | |
|---|---|---|---|---|
| JP | 59218458 | A | * | 12/1984 |
| JP | 02168268 | A | * | 6/1990 |
| JP | 6-051631 | A | | 2/1994 |
| JP | 06110247 | A | * | 4/1994 |
| JP | 7-028271 | A | | 1/1995 |
| JP | 8-202137 | A | | 8/1996 |
| JP | 8-248727 | A | | 9/1996 |
| JP | 11212327 | A | * | 8/1999 |
| JP | 2000-98712 | | | 4/2000 |
| JP | 2000-293009 | | | 10/2000 |
| JP | 2001-1249546 | A | | 9/2001 |
| JP | 2002333767 | A | * | 11/2002 |

OTHER PUBLICATIONS

Japanese Notification of Reasons for Refusal mailed on Oct. 31, 2006.

* cited by examiner

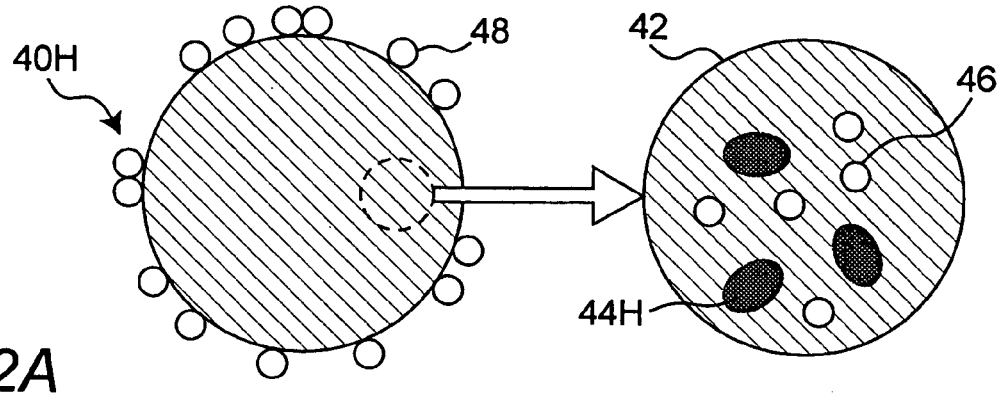
Fig.2A
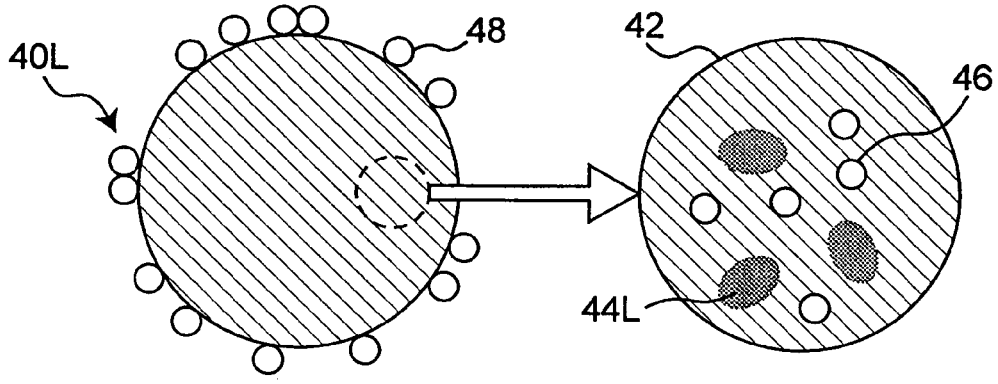
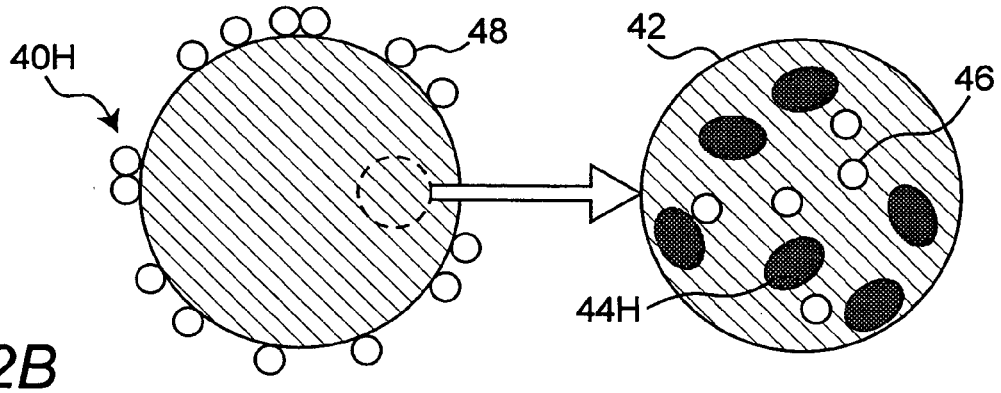
Fig.2B
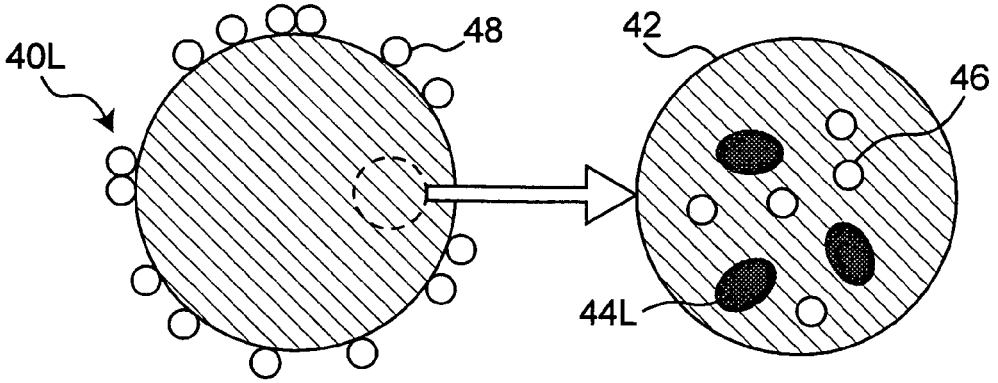

IMAGE FORMING APPARATUS AND A DEVELOPING APPARATUS HAVING A UNIT FOR DETERMINING A MIXTURE RATIO OF TWO TYPES OF MAGNETIC TONER BASED ON MAGNETIC PERMEABILITY AND AMOUNT

RELATED APPLICATION

This application is based on Japanese Patent Application No. 2004-229099, the content of which is incorporated herein by reference.

BACKGROUND OF THE INVENTION

1. Field of the Invention

The present invention generally relates to an electrophotographic image forming apparatus such as copying machine, printer, facsimile or multifunction peripheral having functions of printing, copying, faxing and the like. More particularly, the present invention relates to an image forming apparatus that utilizes a mixed developer containing a plurality of types of toner having a generally identical hue and different reflection densities. The present invention also relates to a developing apparatus used for such an image forming apparatus.

2. Description of the Related Art

There has been known an image forming device which enables image quality of images with highlight areas to be improved and the consumption of a developer to be suppressed.

Japanese Patent Publication No. 2000-98712 discloses an image forming device that utilizes a mixed developer including two types of toner having an identical hue and different reflection densities.

The amount of electrostatic charge on the toner with a low reflection density is set to be smaller than that of the toner with a high reflection density. Thus, the toner with a low reflection density is supplied more easily from a developing roller onto a photoreceptor drum than the toner with a high reflection density. Accordingly, in case where latent image areas with a "low density" (where the amount of exposure is small and therefore their decay level of electric potential is low) on the photoreceptor drum are developed, the toner with a low reflection density is mainly used. This suppresses density fluctuations, which would be generated in case where only toner with a high reflection density is used, and allows a fine image without graininess to be formed.

On the other hand, the amount of the toner with a high reflection density in the developing device is set to be larger than that of the toner with a low reflection density. Accordingly, in case where latent image areas having a "high density" (where the amount of exposure is large and therefore their decay level of electric potential is high) on the photoreceptor drum are developed, the toner with a high reflection density is mainly used. This suppresses the consumption of the developer, which would be larger in case where only toner with a low reflection density is used for developing latent image areas having a high density on the photoreceptor drum.

In such an image forming device, a mixture ratio of the two types of toner of the developer needs to be controlled so that it falls within a predetermined range in order to ensure stable image quality after a number of documents have been printed.

Japanese Patent Publication No. 2000-293009 describes an image forming device in which a test patch image is formed on a photoreceptor drum and the reflection density of the test patch image is detected. Toner with a low reflection density is supplied from a toner hopper when the detected reflection density of the test patch image is increased.

However, the mixture ratio of the developer (the mixture ratio of the two types of toner) is difficult to be determined with high accuracy based on the reflection density of the test patch image. Also, a dead time or waiting time is increased due to a series of steps for forming a test patch image and detecting a reflection density thereof.

SUMMARY OF THE INVENTION

An object of the present invention is to provide an image forming apparatus which enables a mixture ratio of the mixed developer to easily be determined with high accuracy.

Another object of the present invention is to provide an image forming apparatus which enables a dead time to be reduced.

To achieve these objects, an aspect of the present invention is an electrophotographic image forming apparatus that includes a developer reservoir for accommodating a single-component mixed developer including two types of toner having a generally identical hue and different reflection densities. A magnetic substance is added to one of the two types of toner. The apparatus also includes a detector for detecting a magnetic permeability of the developer in the reservoir and a unit for determining a mixture ratio of the two types of toner based on the magnetic permeability of the developer detected by the detector.

Herein, the term "magnetic permeability" designates an appearance magnetic permeability which varies according to a mixture ratio of the two types of toners.

With this apparatus, since a magnetic substance is added only to one of the two types of toner having low and high reflection densities, a mixture ratio of the two types of toners in the developer reservoir can be determined with high accuracy just by detecting a magnetic permeability of the mixed developer including the two types of toners in the developer reservoir.

BRIEF DESCRIPTION OF THE DRAWINGS

The above-mentioned and other objects, advantages and features of the invention will become apparent from the following description thereof taken in conjunction with the accompanying drawings in which:

FIG. 2A is a view showing an example of two types of cyan toner with high and low reflection densities, the two types of cyan toner having coloring agents with different reflection densities;

FIG. 2B is a view showing another example of two types of cyan toner with high and low reflection densities, the two types of cyan toner having different amounts of a coloring agent;

DETAILED DESCRIPTION OF THE PREFERRED EMBODIMENTS

With reference to the drawings, preferred embodiments of the present invention will be described hereinafter.

First Embodiment

Figure 1:
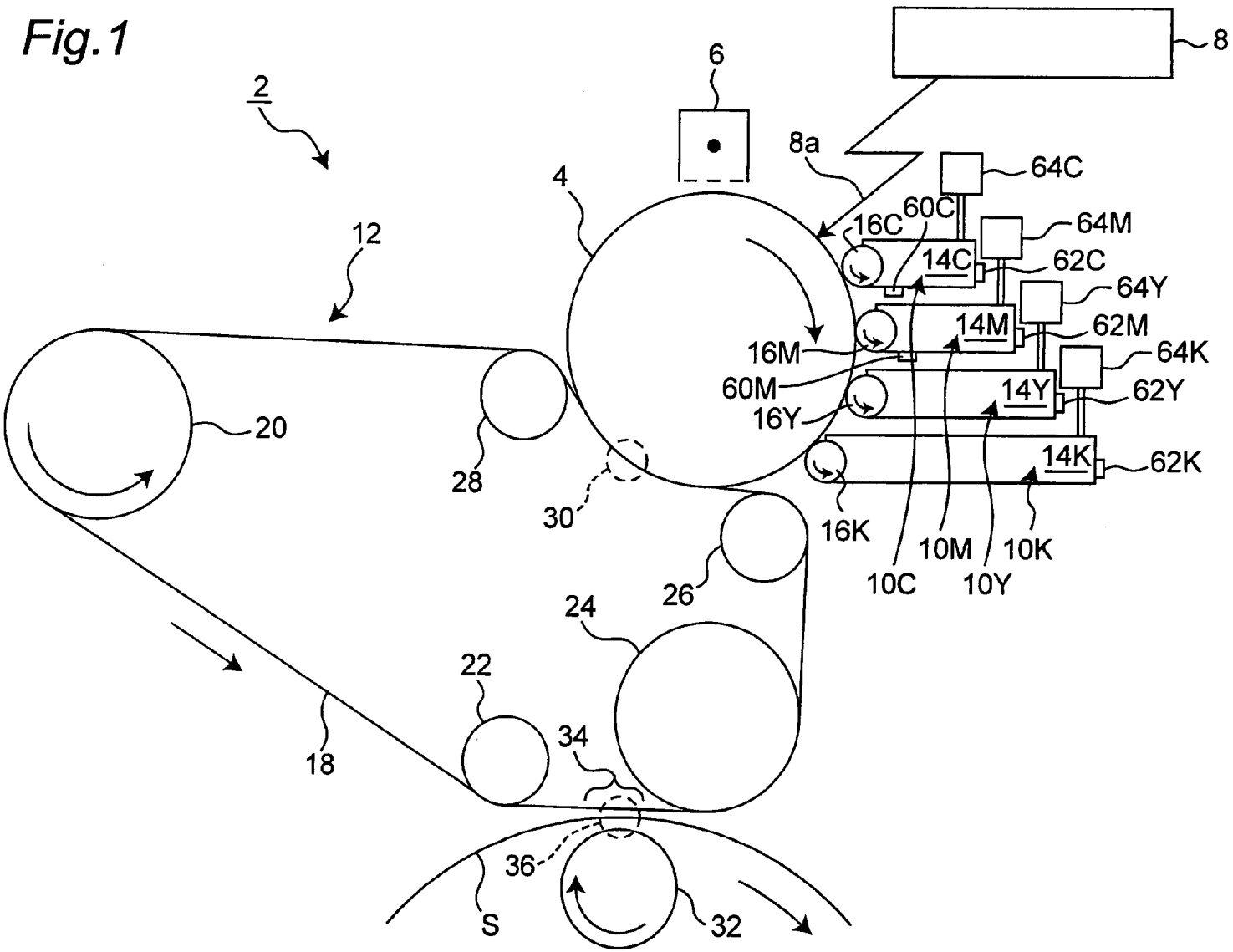
FIG. 1 is a schematic view of a first embodiment of the image forming device according to the present invention.

Referring to FIG. 1, there is shown a color printer, which is a first embodiment according to the present invention. The printer, generally indicated at reference number 2, includes a photoreceptor drum 4 as image bearing member for rotation in a clockwise direction of the drawing. Around the photoreceptor drum 4, a charging device 6, an exposing device 8, four developing devices 10C, 10M, 10Y and 10K and a primary transfer device 12 are positioned in this order along the rotational direction of the drum.

The charging device 6 is used for charging uniformly the surface of the photoreceptor drum 4 (the surface electric potential is $v_0$). The exposing device 8 is used for emitting laser beam 8*a* selectively onto the photoreceptor drum 4 in response to image data to form a latent image on the drum.

Each of the developing devices 10C–10K is used for providing the photoreceptor drum 4 with corresponding toner to visualize the latent image. More specifically, the developing devices 10C, 10M, 10Y and 10K include developer reservoirs 14C, 14M, 14Y and 14K for accommodating cyan(C), magenta(M), yellow(Y) and black(K) developers and developing rollers 16C, 16M, 16Y and 16K each operatively connected with its respective motor not shown so that it can be rotated in the counterclockwise direction of the drawing, respectively. The rotation of each of the developing rollers 16C–16K causes the corresponding developer deposited on the surface of the developing roller to be transported to an opposing region between the developing roller and the photoreceptor drum 4, where the developer is supplied to the latent image portion of the drum. Each of the developing rollers 16C–16K is applied with a bias voltage $V_B$.

The cyan developer in the developer reservoir 14C is a "single-component" (in a sense that it contains no carrier) mixed developer including two types of cyan toner having a generally identical hue and different reflection densities. Hereinafter, the toner with a low reflection density and the toner with a high reflection density are referred to as "LRD toner" and "HRD toner", respectively. Likewise, the magenta developer in the developer reservoir 14M is a single-component mixed developer including two types of magenta toner having a generally identical hue and different (low and high) reflection densities. The yellow developer in the developer reservoir 14Y includes a single type of yellow toner. Likewise, the black developer in the developer reservoir 14K includes a single type of black toner. The mixed developers, i.e. the cyan and the magenta developers will be described in more detail below.

The primary transfer device 12 includes an intermediate transfer belt 18. The intermediate transfer belt 18 is made of resin sheet such as polycarbonate in which carbon black is dispersed so that the belt has a surface electrical resistance of about $10^5$–$10^{12}$ Ω/cm$^2$. The intermediate transfer belt 18 is supported by the circumferences of five rollers 20, 22, 24, 26 and 28. The roller 22 is a tension roller that provides tension to the intermediate transfer belt 18. The roller 20 is operatively connected with a drive motor not shown. The rotation of the roller 20 causes the rollers 22, 24, 26 and 28 to rotate so that the intermediate transfer belt 18 is rotated in the counterclockwise direction of the drawing. The portion of the intermediate transfer belt 18 between the rollers 26 and 28 is in contact with the circumference of the photoreceptor drum 4 to define a primary transfer region 30 where a toner image (cyan, magenta, yellow or black toner image) on the drum is transferred onto the belt.

A secondary transfer roller 32 is mounted for rotation in the clockwise direction of the drawing and is opposed to a portion 34 of the intermediate transfer belt 18 at an immediate upstream side of the roller 24 with regard to the rotational direction of the belt. The secondary transfer roller 32 is made of foam rubber such as silicone or urethane in which carbon black is dispersed so that the roller has a surface electrical resistance of about $10^5$–$10^{12}$ Ω/cm$^2$. The belt portion 34 and the secondary transfer roller 32 define a secondary transfer region 36 where a sheet (recording medium) S passes along a direction indicated by an arrow and superimposed toner images, which will be describe below, on the intermediate transfer belt 18 is transferred onto the sheet.

With the printer 2 so constructed, a controller (described below) controls the charging device 6, so that the surface of the photoreceptor drum 4 is uniformly charged. The controller generates a control signal in response to color image data stored in an image memory not shown and then outputs it to the exposing device 8. The exposing device 8 selectively emits laser beam 8*a* onto the photoreceptor drum 4. As a result, the electric potential of surface portions where the laser beam 8*a* is emitted is decayed, so that a latent image for cyan is formed on the photoreceptor drum 4. The latent image for cyan on the photoreceptor drum 4 is visualized by supplying a mixed cyan developer to the latent image by means of the developing device 10C to form a cyan toner image. The cyan toner image is transported by the rotation of the photoreceptor drum 4 to the primary transfer region 30 and transferred onto the intermediate transfer belt 18.

Next, a magenta toner image of a mixed magenta developer, which has been formed on the photoreceptor drum 4 in a similar manner, is transferred onto the intermediate transfer belt 18 so that it is superimposed on the cyan toner image. Then, a yellow toner image of a non-mixed yellow developer, which has been formed on the photoreceptor drum 4 in a similar manner, is transferred onto the intermediate transfer belt 18 so that it is superimposed on the cyan and magenta toner images. Thereafter, a black toner image of a non-mixed black developer, which has been formed on the photoreceptor drum 4 in a similar manner, is transferred onto the intermediate transfer belt 18 so that it is superimposed on the cyan, magenta and yellow toner images.

The superimposed toner images are transported by the movement of the intermediate transfer belt 18 to the secondary transfer region 36. On the other hand, a sheet S is fed from a sheet supply cassette not shown to the secondary transfer region 36. Thus, the superimposed toner images are transferred by means of the secondary transfer roller 32 onto the sheet S moving past the secondary transfer region 36.

The sheet S onto which the color toner image has been formed is supplied to a fixing device not shown, where the color toner image is fixed on the sheet S.

Next, a latent image formed on the photoreceptor drum 4 and a mixed developer will be described in detail.

The printer 2 employs a pulse width modulation technique of the laser beam 8*a* to represent gray levels. Therefore, the latent image includes areas with a "low density" where an electric potential decay level is low and areas with a "high density" where an electric potential decay level is high. Hereinafter, a latent image area with a low density and a latent image area with a high density are referred to as "LD area" and "HD area", respectively. When the laser-emitting period is relatively short, the decay of the electric potential of the photoreceptor drum surface is small (i.e., the electric potential does not reach a saturation point), thereby forming an LD area. On the other hand, when the laser-emitting period is sufficiently long, the decay of the electric potential of the photoreceptor drum surface is large (i.e., the electric potential reaches a saturation point), thereby forming an HD area. In the specification, the LD area designates an area where a developer is supplied to create a highlight area. The HD area designates an area where a developer is supplied to create a shadow area.

As described above, the cyan developer is a mixed developer including two types of toner having a generally identical hue and different reflection densities. The mixture ratio of the developer in the reservoir 14C is adjusted to be equal or more than a predetermined value $R_L$. In the embodiment, the mixture ratio is defined as a weight ratio of the LRD toner to the HRD toner, although other definition may be used instead. According to the definition, $R_L$ is more than zero and is less than one. In other words, the amount of the HRD cyan toner is larger than that of the LRD cyan toner in the reservoir 14C.

FIGS. 2A and 2B show examples of the LRD and the HRD cyan toners. In an example of FIG. 2A, the HRD toner 40H is made of resin 42 in which a coloring agent 44H and a charge control agent 46 are dispersed. An external additive 48 may be added. The LRD toner 40L is generally identical to the HRD toner 40H except that the coloring agent 44L has a lower reflection density than the coloring agent 44H. In an example of FIG. 2B, the coloring agent 44H and 44L have an identical reflection density. The weight ratio of the coloring agent 44H to the resin 42 is higher than the weight ratio of the coloring agent 44L to the resin 42. In the latter, the suitable range of the mixture ratio is set to be equal to or more than 0.45 while the weight ratios are 4 and 10 percents with regard to the LRD cyan toner and the HRD cyan toner, respectively, for instance.

In order that an adhesive force of the LRD cyan toner with regard to the developing roller 16C of the developing device 10C is smaller than that of the HRD cyan toner to allow the LRD cyan toner to more easily be deposited onto the photoreceptor drum 4, an amount of electrostatic charge on the LRD cyan toner is smaller than that on the HRD cyan toner. For this purpose, a mean particle size of the LRD cyan toner may be different from that of the HRD cyan toner or different amounts of after-treatment agent such as charge control agent may be added to the LRD and the HRD cyan toners.

Instead, the LRD cyan toner may have a higher sphericity than the HRD cyan toner in order that an adhesive force of the LRD with regard to the developing roller 16C is smaller than that of the HRD cyan toner.

Figure 3:
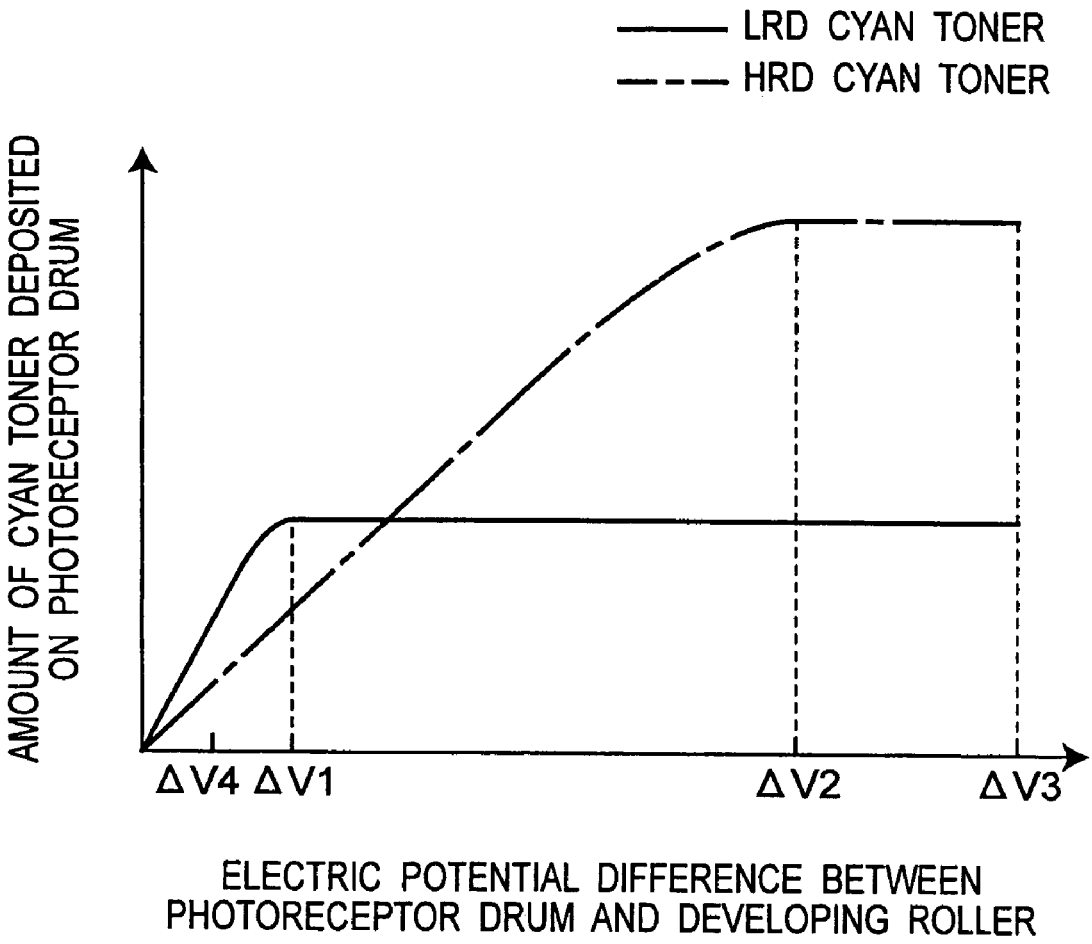
FIG. 3 is a graph showing an amount of the cyan toner with a high reflection density or the cyan of toner with a low reflection density supplied onto the photoreceptor drum as a function of an electric potential difference between the drum and the developing roller.
Figure 4:
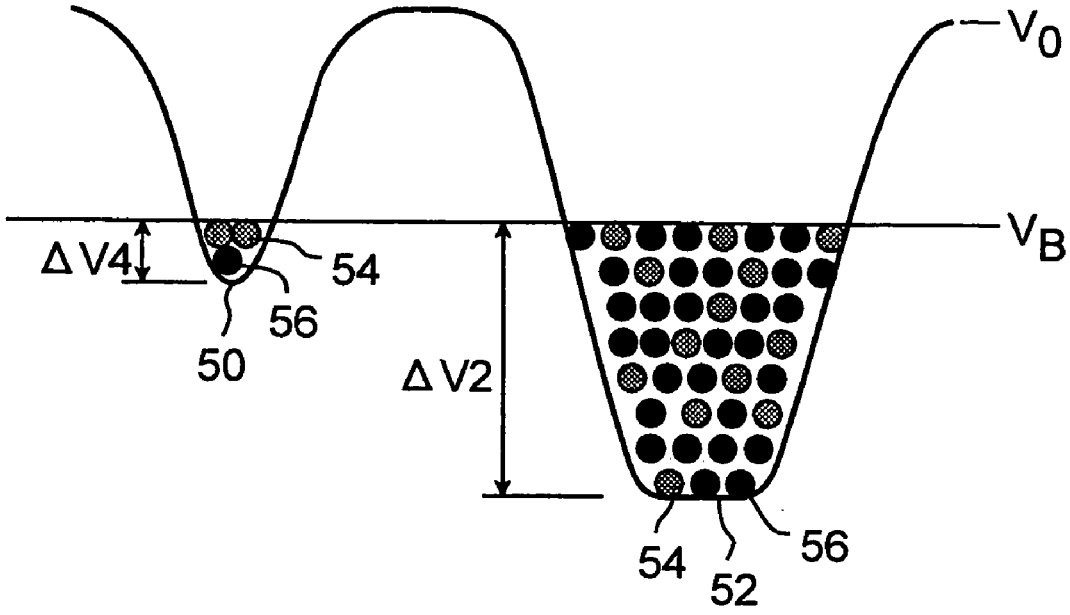
FIG. 4 is a view showing a relationship of an electric potential difference between the photoreceptor drum and the developing roller and a ratio of amounts of two types of cyan toners with high and low reflection densities supplied to the drum.

Referring now to FIGS. 3 and 4, a characteristic of the mixed cyan developer including the HRD and the LRD cyan toners will be described. FIG. 3 shows an amount of the HRD or the LRD cyan toner deposited on the photoreceptor drum as a function of an electric potential difference between the developing roller applied with a bias voltage $V_B$ and a latent image area on the drum.

As shown in FIG. 3, where an electric potential difference between the developing roller and a latent image area of the photoreceptor drum is relatively low, the LRD cyan toner is mainly supplied to the area, since the LRD cyan toner is less adhesive than the HRD cyan toner to the developing roller. Where the electric potential difference between the developing roller and a latent image area of the photoreceptor drum is lower than a value Δ V1, the higher the electric potential difference is, the larger the amount of the LRD cyan toner supplied to the latent image area of the photoreceptor drum is. Where the electric potential difference is higher than Δ V1, the amount of the LRD cyan toner supplied to the photoreceptor drum is substantially constant, i.e., the amount reaches a saturation point. This means that most of the LRD cyan toner in the mixed cyan developer opposed to the latent image area is supplied to the area where the electric potential difference is high to some degree.

On the other hand, where an electric potential difference between the developing roller and a latent image area of the photoreceptor drum is relatively low, the amount of the HRD cyan toner supplied to the area is small. However, the higher the electric potential difference between the developing roller and a latent image area of the photoreceptor drum is, the larger the amount of the HRD cyan toner supplied to the latent image area of the drum is, as long as the electric potential difference is lower than a value Δ V2. Where the electric potential difference is higher than Δ V2, the amount of the HRD cyan toner supplied to the photoreceptor drum is substantially constant, i.e., the amount reaches a saturation point. This means that most of the HRD cyan toner in the mixed cyan developer (and therefore most of the mixed cyan developer) opposed to the latent image area is supplied to the area when the electric potential difference is sufficiently high. A weight ratio of the two types of cyan toner supplied onto the photoreceptor drum in case where the electric potential difference is more than Δ V2 is generally identical to a mixture ratio of the two types of cyan toner in the reservoir 14C. Note that, in FIG. 3, a value Δ V3 designates an electric potential difference which corresponds to the electric potential of the latent image area of the photoreceptor drum where the potential reaches a saturation point.

FIG. 4 shows a relationship of an electric potential difference between each of two latent image areas on the photoreceptor drum and the developing roller and a ratio of amounts of two types of cyan toner supplied to the each of the latent image areas. A latent image area 50 is an LD area (where a highlight area is created) that corresponds to an electric potential difference Δ V4 in FIG. 3. A latent image area 52 is an HD area (where a shadow area is created) that corresponds to the electric potential difference Δ V2 in FIG. 3. As shown, a larger amount of the LRD cyan toner 54 is supplied to the LD area 50 than the amount of the HRD cyan toner 56. On the other hand, a larger amount of the HRD cyan toner 56 is supplied to the HD area 52 than the amount of the LRD cyan toner 54.

As is apparent from the above description, the LRD cyan toner is inevitably used for developing HD areas (corresponding to shadow areas). Therefore, where an HD area is developed, the HRD cyan toner used in the printer 2 according to the embodiment needs to have a larger reflection density than a single type of cyan toner used in a conventional image forming device, in order to obtain an identical image density to that in case of the conventional device under the condition that an amount of the cyan developer (including the LRD and the HRD toners) deposited on the photoreceptor drum is identical to that of the conventional single type of cyan toner. For example, where a weight ratio of the coloring agent to the resin in a conventional single type of cyan toner is 8%, the weight ratio in the case of the HRD cyan toner is set to be 10%.

As described, the LRD cyan toner 54 is mainly used for developing an LD area (corresponding to a highlight area). The same holds true for the magenta developer. Therefore, the printer 2 allows a fine image without graininess to be formed by developing an LD area mainly with the LRD toner.

With regard to the cyan and magenta developers, where images with relatively many highlight areas such as photographic image are successively printed using the printer 2, a large amount of the LRD toner is consumed. As a result, the amount of the LRD toner per volume in the developer is decreased. This causes an increased amount of the HRD toner to be supplied from the developing roller to LD areas, resulting in increased graininess of the image. As the amount of the LRD toner is decreased, the mixture ratio of the developer is decreased. Thus, the printer 2 is designed so that each mixture ratio of the cyan and the magenta developers is controlled to be equal to or more than an appropriate predetermined value $R_L$.

For this purpose, with regard to the cyan and magenta developers, a magnetic substance such as iron powder, ferrite or magnetic fine particles is added only to the HRD toner. That is, each of the cyan and magenta developers includes of magnetic and non-magnetic toners. Accordingly, the consumption of the mixed developer causes a mixture ratio thereof to change, resulting in a change in a magnetic permeability (appearance magnetic permeability) of the developer.

Figure 5:
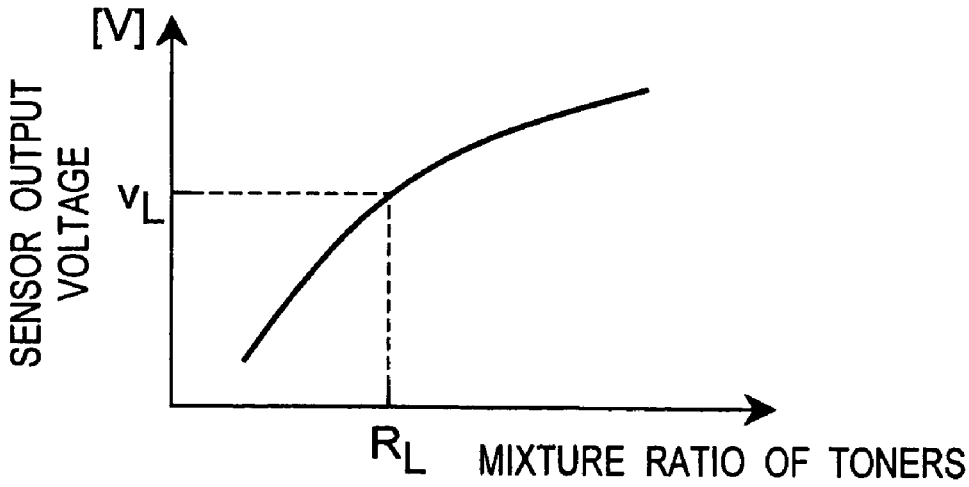
FIG. 5 is a graph showing a relationship between a mixture ratio of the two types of toner in the developer reservoir and a voltage outputted from the magnetic permeability detection sensor shown in FIG. 1.

Referring back to FIG. 1, the developing devices 10C an 10M include sensors 60C and 60M, located at bottom walls of the reservoirs 14C and 14M, for generating a signal used to determine mixture ratios of the cyan and the magenta developers therein, respectively. Each of the sensors 60C and 60M is an inductance detection type sensor that detects a magnetic permeability of the corresponding mixed developer per volume and emits an electrical signal or voltage signal indicative of the magnetic permeability. As shown in FIG. 5, the sensors 60C and 60M are designed so that they generate a higher detection voltage as the magnetic permeability is lower (the percentage of the non-magnetic LRD is higher). A voltage outputted from the sensor 60C or 60M that is equal to or more than $v_L$ corresponds to a mixture ratio equal to or more than the lower limit $R_L$.

The developing devices 10C, 10M, 10Y and 10K include empty sensors 62C, 62M, 62Y and 62K for detecting whether there is some amount of the developer, which ensures that image quality is sufficient, remaining in the reservoirs 14C, 14M, 14Y and 14K, respectively (in other words, whether the reservoir of the developing device is nearly empty of developer). The empty sensor may include light-emitting and light-detecting elements, for example. Where the developer prevents light emitted from the light-emitting element from entering the light-detecting element, the empty sensor does not output a signal, indicating that there is sufficient amount of developer remaining in the reservoir. Where light emitted from the light-emitting element enters the light-detecting element, the empty sensor outputs a signal, indicating that there is only a slight amount of developer remaining in the reservoir, which would result in insufficient image quality.

Figure 6:
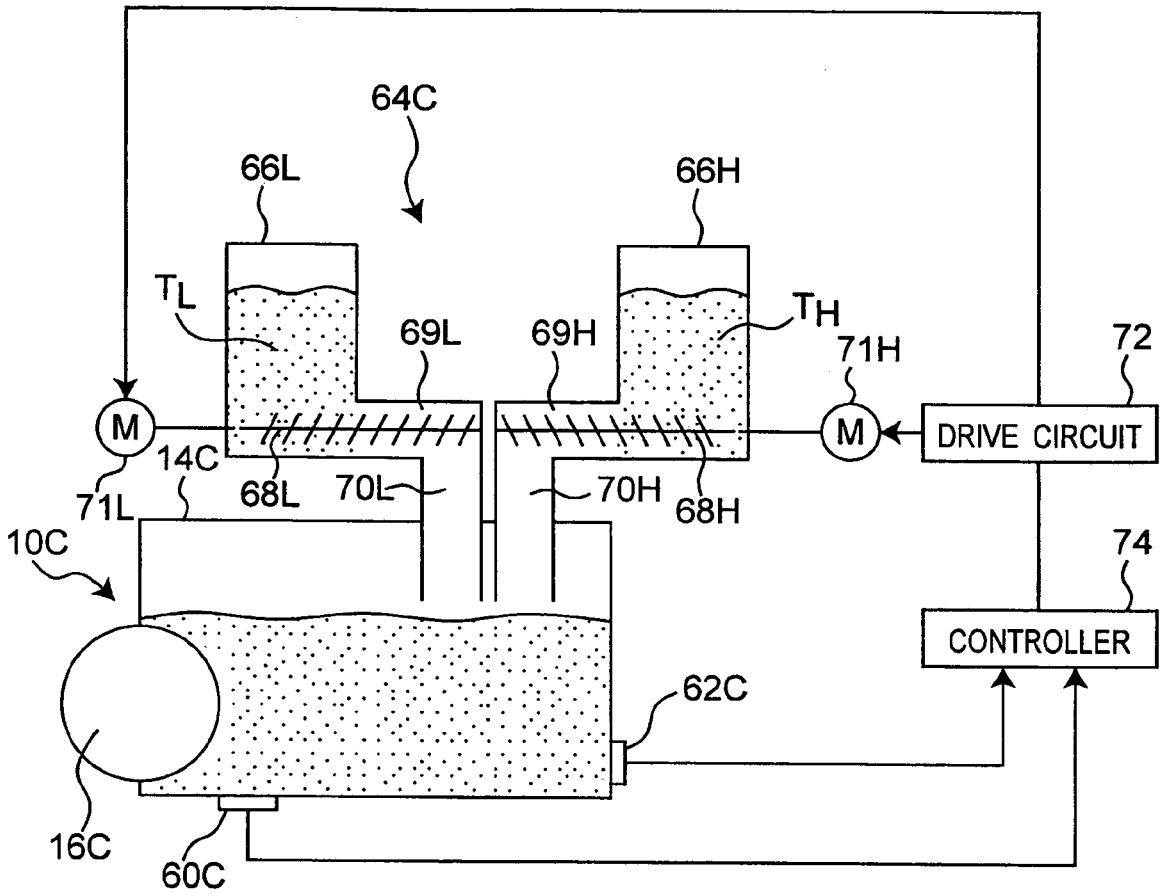
FIG. 6 is an enlarged schematic view of the developing device for cyan and the replenishment device for supplying a cyan developer to the developing device of the image forming device in FIG. 1.

Connected with the developing device 10C, 10M, 10Y and 10K are replenishment devices 64C, 64M, 64Y and 64K, respectively, for replenishing corresponding developers to the developing device. More specifically, as shown in FIG. 6, the replenishment device 64C includes two toner containers 66L and 66H for accommodating LRD cyan toner $T_L$ and HRD cyan toner $T_H$ and conveying screws 68L and 68H for conveying the LRD toner and the HRD toner through passages 69L and 69H to apertures 70L and 70H, where the LRD toner and the HRD toner fall into the reservoir 14C. The reservoir 14C includes an agitator not shown for agitating and mixing the LRD and the HRD toners. The screws 68L and 68H are operatively connected with motors 71L and 71H, respectively, which are in turn electrically connected with a drive circuit 72. The drive circuit 72 drives the motors 71L and 71H in response to a signal from a controller 74 for controlling a printing operation of the printer 2.

The replenishment device 64M is identical to the replenishment device 64C except that LRD magenta toner and HRD magenta toner are accommodated in the two containers, respectively.

The replenishment devices 64Y and 64K are a conventional one that includes one container in which a single type of toner is accommodated and therefore are not described further.

The sensors 60C and 62C are designed to output detection signals to the controller 74. Although not illustrated, the detection signals from the other sensors 60M, 62M, 62Y and 62K are also outputted to the controller 74. As described below, in response to a detection signal with regard to one of the developing devices, the controller 74 controls the corresponding replenishment device so that controlled amount(s) of the toner(s) are replenished to the reservoir.

Figure 7:
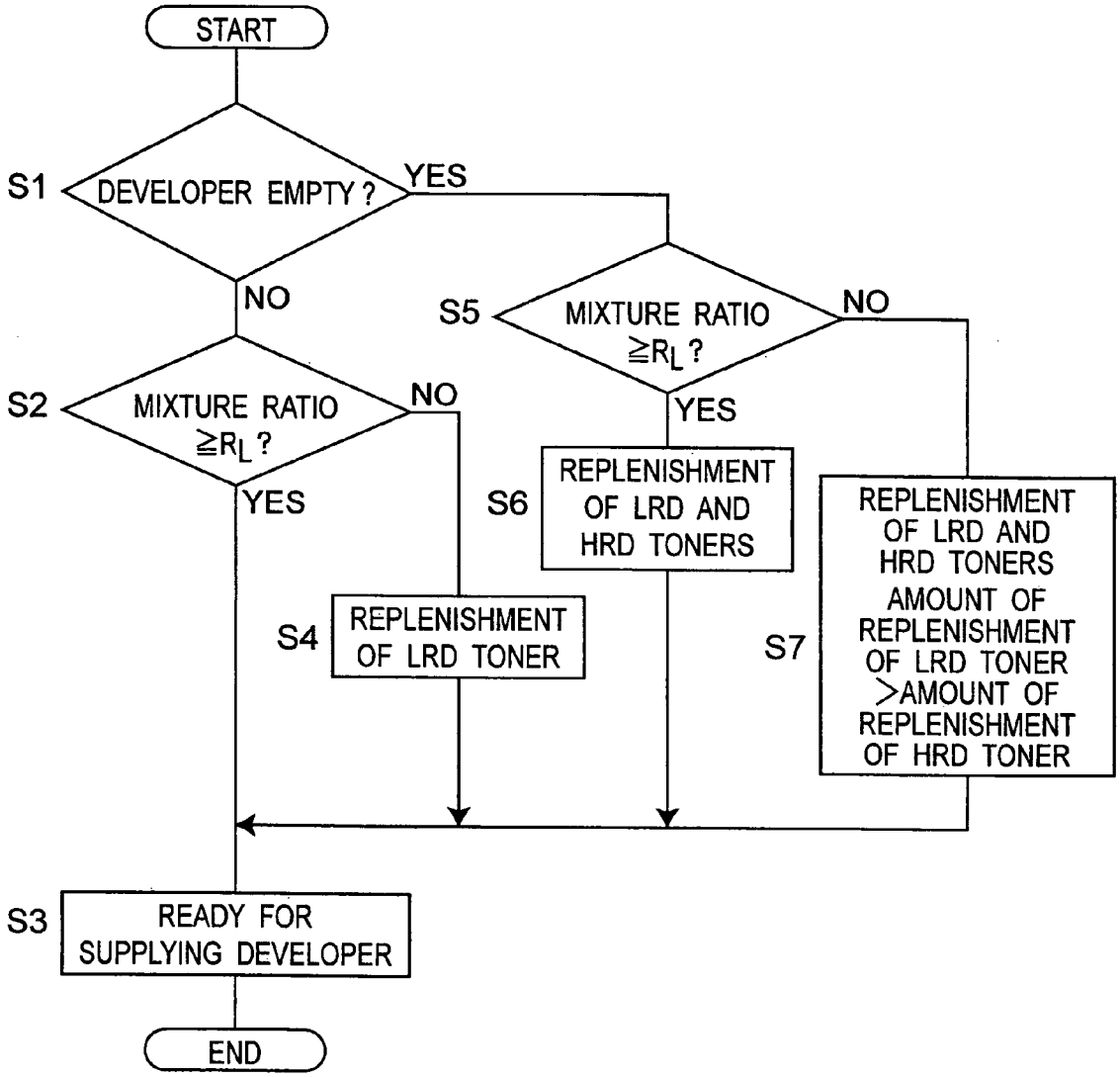
FIG. 7 is a flowchart illustrating a replenishment sequence of the cyan developer in the first embodiment.

Referring now to FIGS. 6 and 7, a replenishment sequence of the cyan developer will be described. This sequence is performed, for example, when the printer 2 is activated and/or every time when the developing device 10C has operated for a predetermined period of time. First, at step 1, the controller 74 makes a determination as to whether a detection signal is outputted from the empty sensor 62C. If the determination is negative, i.e., a sufficient amount of the cyan developer remains in the reservoir 14C, the process moves to step 2, where the controller 74 makes a determination based on a signal from the magnetic permeability detection sensor 60C as to whether the detection voltage is equal to or more than $v_L$ (i.e., whether the mixture ratio is equal to or more than $R_L$). As such, the controller 74 serves as a unit to determine a mixture ratio of the two types of toner based on a magnetic permeability of the mixed developer in the reservoir 14C detected by the magnetic permeability sensor 60C. If the determination is affirmative, no replenishment is performed and the developing device 10C is ready to supply the cyan developer to the photoreceptor drum 4. Thereafter, the process is done.

If the determination is negative at step 2 (i.e., there is no sufficient amount of the LRD cyan toner in the reservoir 14C), the LRD cyan toner is replenished from the container 66L to the reservoir 14C so that the detection voltage is equal to or more than $v_L$ (the mixture ratio is equal to or more than $R_L$) at step 4. Thereafter, the process moves to step 3.

If the determination is affirmative at step 1, i.e., a sufficient amount of the cyan developer does not remain in the reservoir 14C, the controller 74 makes a determination at step 5 based on a signal from the magnetic permeability detection sensor 60C as to whether the detection voltage is equal to or more than $v_L$. If the determination is affirmative, the process moves to step 6, where suitable amounts of the HRD and the LRD toners are replenished from the containers 66H and 66L to the reservoir 14C so that the detection voltage remains equal to or more than $v_L$ (the mixture ratio remains equal to or more than $R_L$). Thereafter, the process moves to step 3.

If the determination is negative at step 5, i.e., the percentage of the amount of the LRD cyan toner in the reservoir 14C is small, the process moves to step 7, where both the LRD cyan toner and the HRD cyan toner are replenished from the containers 66L and 66H to the reservoir 14C so that the detection voltage is equal to or more than $v_L$ (the mixture ratio is equal to or more than $R_L$). The amount of the LRD cyan toner to be replenished is larger than that of the HRD cyan toner. Only the LRD cyan toner may be replenished to the reservoir 14C although only a small amount of the HRD cyan toner remains in the reservoir. Thereafter, the process moves to step 3.

As described above, the replenishment sequence is carried out when the printer 2 is activated and/or each time when the developing device 10C has operated for a predetermined period of time. In addition, it may be automatically started when the controller 74 receives a signal from the empty sensor 62C, indicating that the reservoir of the developing device 10C is nearly empty of developer. In this case, the steps 3 and 5 to 7 are performed.

A replenishment sequence of the magenta developer is identical to that of a cyan developer.

A replenishment sequence of the yellow and black developers is a conventional one. That is, the controller 74, when receiving a detection signal from the empty sensor 62Y or 62K, controls the replenishment device 64Y or 64K to replenish the corresponding developer from the container to the reservoir 14Y or 14M.

The printer 2 is ready for printing when all of the developing devices 10C–10K are ready to supply the developers to the photoreceptor drum 4.

As such, since a magnetic substance is added to one of the toners of the mixed developer, the mixture ratio of the mixed developer can easily be determined with high accuracy by detecting the magnetic permeability of the mixed developer. Also, unlike the above-mentioned conventional device, a test patch image needs not to be formed and therefore the printer 2 can be ready for printing with a shorter dead time.

The same effect can be achieved by adding a magnetic substance only to the LRD toner in the mixed developer, instead of only to the HRD toner. However, a magnetic substance is preferably added only to the HRD toner as in the embodiment, because a magnetic substance has a tendency to reduce the saturation of a color.

Second Embodiment

The image forming device of the present embodiment is similar to the device or printer 2 of the first embodiment except that a magnetic substance is added to each of the HRD and the LRD toners of the mixed developer (for example, cyan developer). Also, the HRD and the LRD toners are prepared so that they have different magnetic permeabilities by, for example, adding different kinds of magnetic substance to the HRD and the LRD toners. Hereinafter, only a developing sequence of the mixed cyan developer is described.

Figure 8:
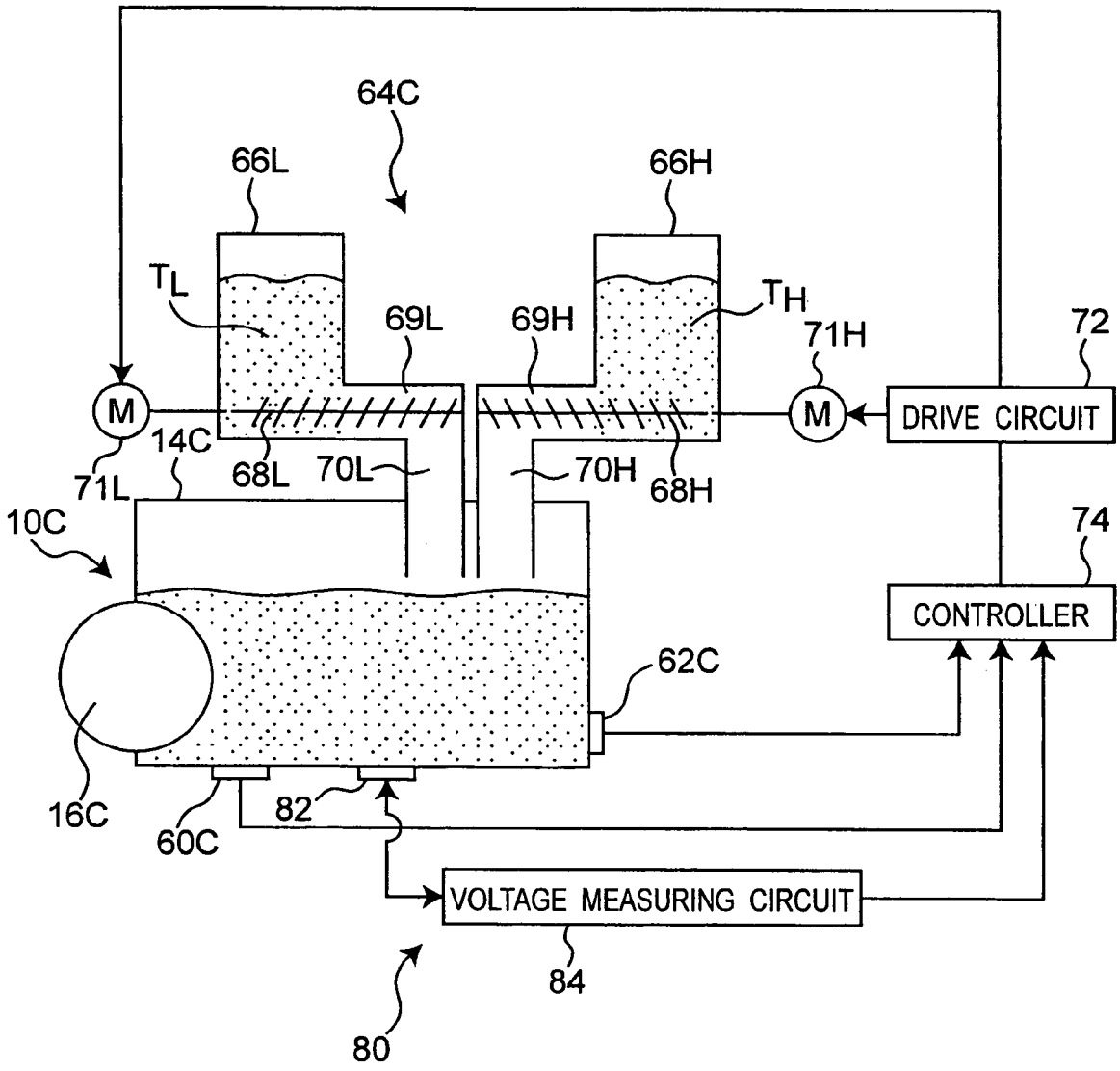
FIG. 8 is a schematic view of a developing device for cyan and a replenishment device for supplying a cyan developer to the developing device in a second embodiment of the image forming device according to the present invention.

In the embodiment, a detector 80 is provided for detecting an amount of the cyan developer remaining in the reservoir 14C that accommodates the cyan developer, as shown in FIG. 8. The detector 80 includes, for example, a pressure-sensitive element 82 including a semiconductor element exhibiting a piezo-resistance effect and located at the bottom wall of the reservoir 14C. The pressure-sensitive element 82 includes a piezoelectric element (not shown) and a pair of electrodes (not shown) formed on either side of the element so that a pressure generated by the weight of the cyan developer in the reservoir 14C is applied to one of the electrodes. The detector 80 also includes a circuit 84 for measuring a voltage or electric potential difference between the electrodes of the pressure-sensitive element 82. As the amount of the cyan developer in the reservoir 14C is decreased, a pressure applied to the piezoelectric element is decreased. Accordingly, an ohmic value of the resistance of the piezoelectric element is larger, resulting in a larger difference in electric potential between the electrodes. The detector 80 outputs a detection signal indicative of the electric potential difference to the controller 74. The difference corresponds to an amount of the cyan developer remaining in the reservoir 14C.

Note that the detector 80, which detects an amount of the cyan developer in the reservoir 14C, may serve to detect whether the reservoir 14C is nearly empty of cyan developer. In this case, the empty sensor 62C is omitted.

A mixture ratio of the two types of toner is determined as follows. In the following, $W_L$ and $\mu_L$ designate a residual amount (weight) and a magnetic permeability of the LRD cyan toner $T_L$ in the reservoir 14C, respectively. $W_H$ and $\mu_H$ designate a residual amount (weight) and a magnetic permeability of the HRD cyan toner $T_H$ in the reservoir 14C, respectively. $\mu'$ designates a magnetic permeability of the mixed cyan developer. The values $W_L$, $\mu_L$, $W_H$, $\mu_H$ and $\mu'$ satisfy a following equation.

$$\mu'=(W_L\mu_L+W_H\mu_H)/(W_L+W_H) \tag{1}$$

Using $W'=W_L+W_H$, a residual amount of the cyan developer in the reservoir 14C, the equation (1) is reduced to $$\begin{aligned}\mu' &= \{(W'-W_H)\mu_L + W_H\mu_H\}/W' \\ &= (\mu_H-\mu_L)/W' \times W_H + \mu_L\end{aligned} \tag{2}$$

$\mu'$ and $W'$ are determined based on detection signals from the permeability detection sensor 60C (first detector) and the residual amount detector 80 (second detector), respectively. $\mu_H$ and $\mu_L$ are known and different from each other. Accordingly, the controller 74 can determine $W_H$ and therefore a mixture ratio of the two types of toner $W_L/W_H$ based on the equation (2).

As such, where a magnetic substance is added to each of the LRD and the HRD toners, a mixture ratio of the toners can be determined by setting the toners to have different magnetic permeabilities and detecting an amount of the mixed developer remaining in the reservoir.

As described above, a magnetic substance has a tendency to reduce the saturation of a color, the amount of a magnetic substance added to the LRD toner is preferably smaller than that added to the HRD toner.

A detector for detecting a residual amount of the developer is not limited to the detector 80. For example, a piezo-electric vibration sensor typically used for an empty sensor may detect a residual amount of the developer.

There has been described in detail for preferred embodiments of the image forming apparatus according to the present invention, but it is to be understood that various modifications can be effected within the spirit and scope of the invention. For example, although in the previous embodiments a single-component developer including two types of toner and no carrier is used, a "two-component" developer including two types of magnetic toners with different reflection densities and a magnetic carrier may be used. A mixture ratio of the two types of toner may be determined as follows. In the following, $W_C$ and $\mu_C$ designate a residual amount (weight) and a magnetic permeability of the carrier in the reservoir, respectively. The values $W_L$, $\mu_L$, $W_H$, $\mu_H$, $W_C$, $\mu_C$ and $\mu'$ satisfy a following equation.

$$\mu'=(W_L\mu_L+W_H\mu_H+W_C\mu_C)/(W_L+W_H+W_C) \quad (3)$$

Using $W'=W_L+W_H+W_C$, a residual amount of the developer in the reservoir, the equation (3) is reduced to $$\begin{aligned}\mu' &= \{(W' - W_H - W_C)\mu_L + W_H\mu_H + W_C\mu_C\}/W' \quad (4)\\ &= (\mu_H - \mu_L)/W' \times W_H + \{(W' - W_C)\mu_L + W_C\mu_C\}/W'\end{aligned}$$

$\mu'$ and $W'$ are determined based on detection signals from the magnetic permeability detection sensor and the residual amount detector, respectively. $\mu_H$ and $\mu_L$ are known and different from each other. Since the carrier is not substantially consumed, $W_C$ is known and substantially constant. Accordingly, the controller can determine $W_H$ and therefore a mixture ratio of the two types of toner $W_L/W_H$ based on the equation (4).

In this construction, in order that the LRD toner is supplied more easily from the magnetic carrier to the photoelectric drum than the HRD toner, some parameters such as amounts of electrostatic charge on the two types of toner, a kind and/or an amount of a magnetic substance contained in each type of the toners need to be adjusted.

Also, although in the previous embodiments only the cyan and magenta developers are a mixed developer having two types of toner with different reflection densities, the yellow and/or black developers may be a mixed developer.

In the previous embodiments, only a lower limit of the mixture ratio of the mixed developer is taken into consideration. This means a mixture ratio may decrease but never rises as the number of documents that have been printed is increased. More specifically, where images having many shadow areas such as character image are successively printed, consumption of the HRD toner is large. However, since the HRD and the LRD toners continue to be consumed in a ratio (weight ratio) generally identical to the mixture ratio in the developer reservoir, the mixture ratio never rises. An upper limit may, however, be preferably set so that controlled amount(s) of the toner(s) are replenished from the replenishment device in order that the mixture ratio of the mixed developer never exceeds the upper limit.

Although in the previous embodiments the mixture ratio of a mixed developer is defined as a ratio of the residual amount of the LRD toner to that of the HRD toner, it may be defined in a different way, as mentioned above. For example, where the mixture ratio is defined as a ratio of the residual amount of the HRD toner to that of the LRD toner, an upper limit thereof needs to be taken into consideration instead of a lower limit.

In the previous embodiments, the controller 74 serves to control a printing operation and determine a mixture ratio of the toners in the developer reservoir based on a detection signal of the magnetic permeability detection sensor 60C. A calculation unit (other than the controller 74) for determining a mixture ratio may be incorporated in a developing apparatus. In this case, the developing apparatus is designed to be removably attached to the image forming apparatus.

In addition, the present invention is not limited to a color image forming apparatus and may be applied to a monochrome image forming apparatus (not limitative of an apparatus for black). Also, the present invention can be applied to an image forming apparatus other than a printer.

What is claimed is:

1. An electrophotographic image forming apparatus, comprising:

a developer reservoir for accommodating a single-component mixed developer including two types of magnetic toner having a generally identical hue, different reflection densities and different magnetic permeabilities;

a first detector for detecting a magnetic permeability of the developer in the developer reservoir; and a second detector for detecting an amount of the developer in the developer reservoir;

a unit for determining a mixture ratio of the two types of magnetic toner based on the magnetic permeability of the developer detected by the first detector and the amount detected by the second detector.

2. An electrophotographic image forming apparatus, comprising:

a developer reservoir for accommodating a two-component mixed developer including two types of magnetic toner and a magnetic carrier, the two types of magnetic toner having a generally identical hue, different reflection densities and different magnetic permeabilities;

a first detector for detecting a magnetic permeability of the developer in the developer reservoir;

a second detector for detecting an amount of the developer in the developer reservoir; and a unit for determining a mixture ratio of the two types of magnetic toner based on the magnetic permeability of the developer detected by the first detector and the amount detected by the second detector.

* * * * *